United States Patent [19]

Samson et al.

[11] 4,442,838

[45] Apr. 17, 1984

[54] MALIGNANT HYPERTHERMIA MATTRESS

[75] Inventors: J. E. Benoit Samson, Nepean; Lawrence W. Duncan, Munster Hamlet; Jean C. Steffler, Downsview, all of Canada

[73] Assignee: Her Majesty the Queen in right of Canada, as represented by the Minister of National Defence, Ottawa, Canada

[21] Appl. No.: 361,606

[22] Filed: Mar. 25, 1982

[30] Foreign Application Priority Data

Apr. 1, 1981 [CA] Canada ..... 374428

[51] Int. Cl.[3] ..... A47G 7/00; A47C 27/10; A61H 33/00; A61F 7/00

[52] U.S. Cl. ..... 128/369; 4/585; 5/449; 5/453; 5/455; 128/399; 128/402

[58] Field of Search ..... 5/449, 453, 454, 455, 5/456, 450, 421; 4/585–588, 555; 128/365, 369, 370, 374, 399, 402

[56] References Cited

U.S. PATENT DOCUMENTS

| | | | |
|---|---|---|---|
| D. 178,113 | 6/1956 | Chandler et al. | D6/13 |
| 505,873 | 10/1893 | Bomgardner | 5/449 |
| 2,198,804 | 4/1940 | Carlsson | 5/449 |
| 2,471,302 | 5/1949 | Boward | 4/585 |
| 2,504,646 | 4/1950 | Burrow | 4/585 |
| 3,761,975 | 10/1973 | Personett . | |
| 3,775,782 | 12/1973 | Rice et al. | 5/453 |
| 3,833,947 | 9/1974 | Sorenson . | |

*Primary Examiner*—Alexander Grosz

*Attorney, Agent, or Firm*—Cushman, Darby & Cushman

[57] ABSTRACT

A mattress for the treatment of malignant hyperthermia comprises a base to overlie an operating table and an inflatable wall extending around the periphery of the base. The wall includes a pair of discontinuities which permit the patient's arms to extend across the inflated wall. A sealing cuff and flap encompass the arm and seal the discontinuity to prevent egress of water from around the patient. A recess is provided in the wall adjacent the patient's head to allow the anethetist access to the patient when the wall is inflated.

17 Claims, 9 Drawing Figures

FIG. 2
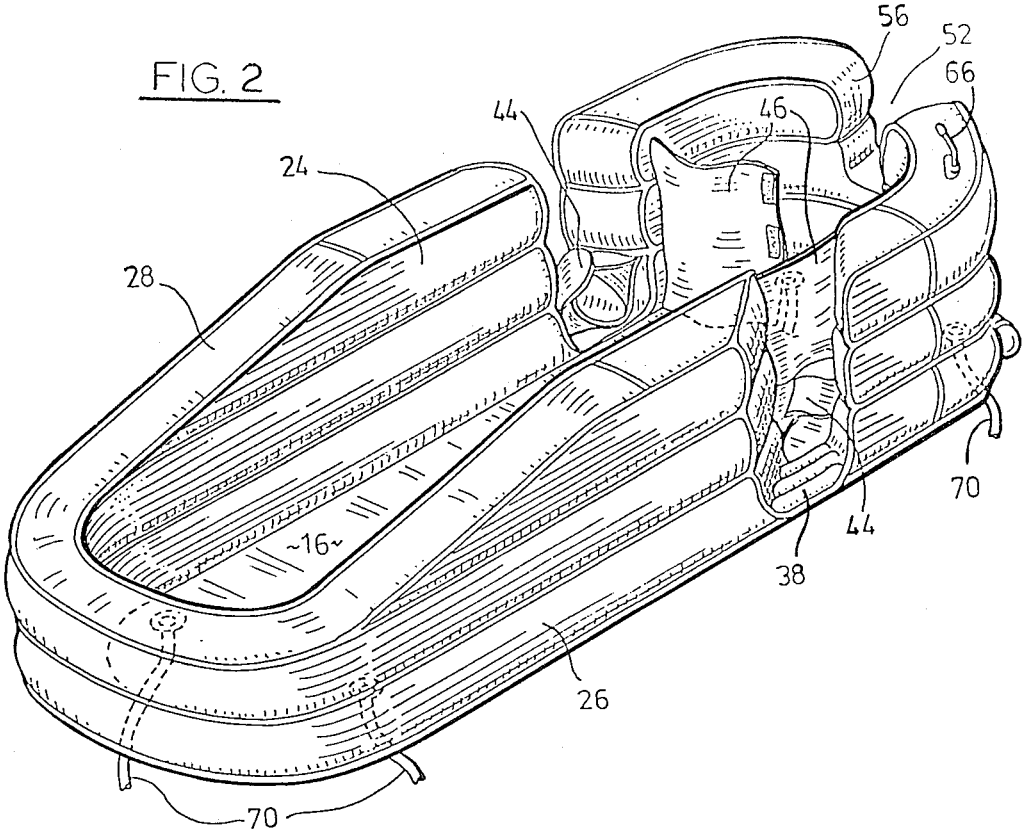
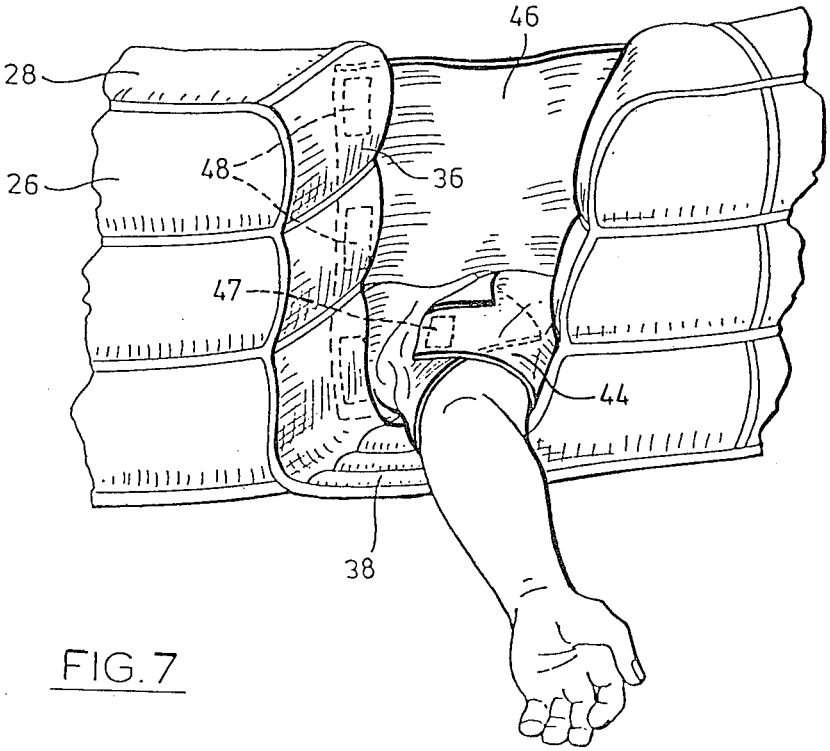
FIG. 7

FIG. 3
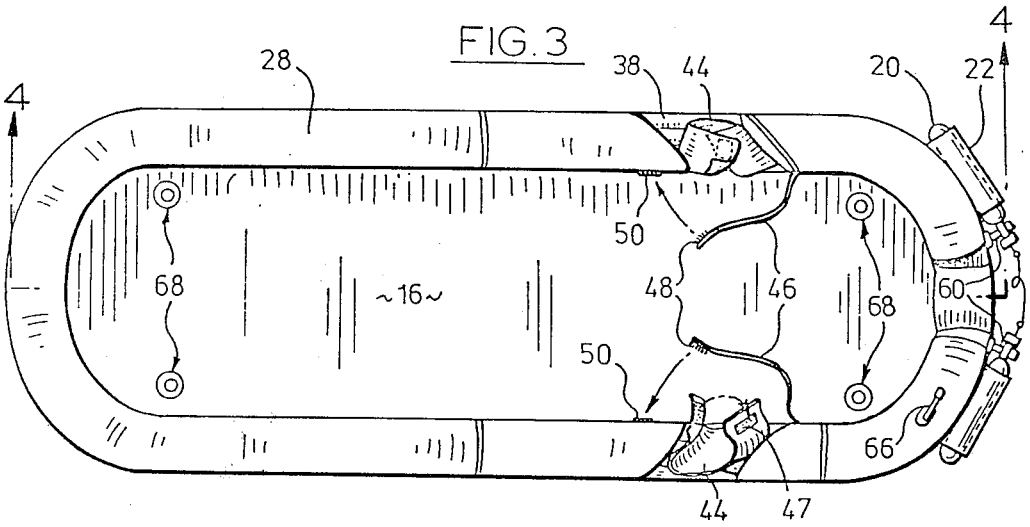
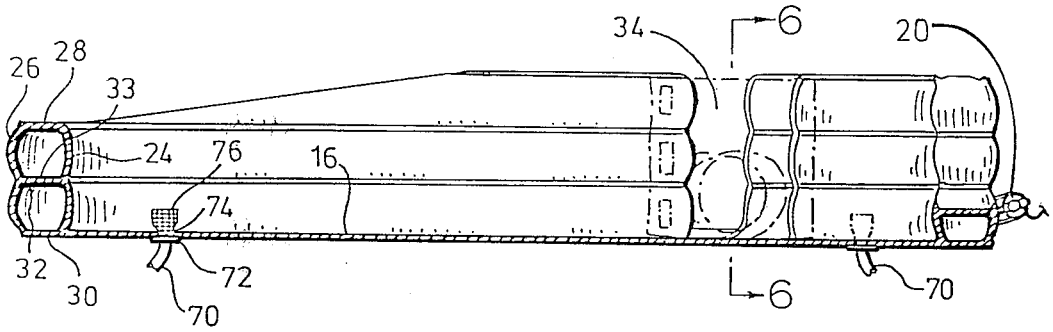
FIG. 4
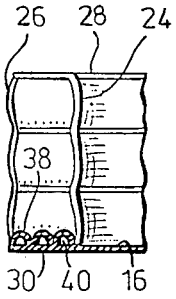
FIG. 6
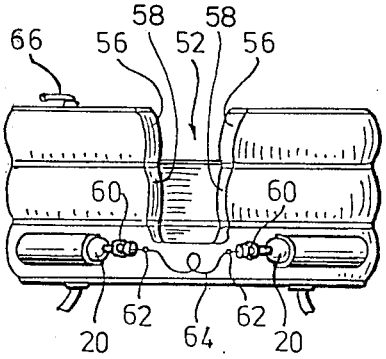
FIG. 5

MALIGNANT HYPERTHERMIA MATTRESS

The present invention relates to a mattress for use in conjunction with a surgical operating table and more particularly to such a mattress that may be used during the treatment of malignant hyperthermia.

Malignant hyperthermia is a life-threatening clinical condition steming from a complication during the administration of an anesthetic under surgical operating conditions. A reaction between the anesthetic agent and the patient's tissues causes a rapid rise in body temperature, which if not reduced promptly, could cause death.

This condition is treated by covering the patient with crushed ice to promote rapid cooling. At the same time it is necessary to maintain the life support systems, such as the administration of anesthetic and plasma, whilst continuing surgical operation on the patient so that he may recover consciousness as quickly as possible.

At present, the crushed ice is maintained around the patients body by means of a sheet which overlies the operating table and which is temporarily suspended from stands. This however is essentially an improvisation and creates an encumberance for the surgeon and his staff, as well as considerable time to set up.

It is therefore an object of the present invention to obviate or mitigate the above disadvantages.

According to the present invention there is provided a mattress adapted to overlie an operating table for use in the treatment of malignant hyperthermia, comprising a base having a peripheral edge, an inflatable wall extending around said peripheral edge and having an upper portion delimiting said wall and a lower portion operatively connected to said base, said wall including a pair of recesses positioned in opposed areas of said wall and extending from said upper portion toward said lower portion, and inflation means associated with said wall to inflate said wall from a generally deflated condition in which said upper edge lies adjacent said base to an inflated condition in which said wall is upstanding.

By providing an inflatable wall, the mattress can be stored around the periphery of the operating table without encumbering the surgeon. As soon as malignant hyperthermia is detected, the wall is already located about the patient so that inflation of the wall will provide a container for the crushed ice.

The recesses in the wall permit the continuing administration of life support systems since the patients arms may remain in an accessible position.

Preferably, flexible flap means extend across the recesses to seal around the patients arms to inhibit the flow of water past the wall of the mattress. This reduces the risk of slippage by staff and also ensures safe operation of electrical shock treatment should emergency heart massage be required.

An embodiment of the invention will now be described by way of example only with reference to the accompanying drawings in which:

FIG. 2 is a perspective view of the mattress shown in FIG. 1 in an inflated condition.

FIG. 3 is a plan view of the mattress shown in FIG. 2.

FIG. 4 is a section on the line 4.4 of FIG. 3.

FIG. 5 is an end elevation of the mattress shown in FIG. 2.

FIG. 6 is a section on the line 6.6 of FIG. 4.

FIG. 7, which appears on the same sheet as FIG. 2, is an enlarged view of a portion of the mattress shown in FIG. 2 indicating the location of a patient's arm when the mattress is in a inflated condition.

Figure 8A:
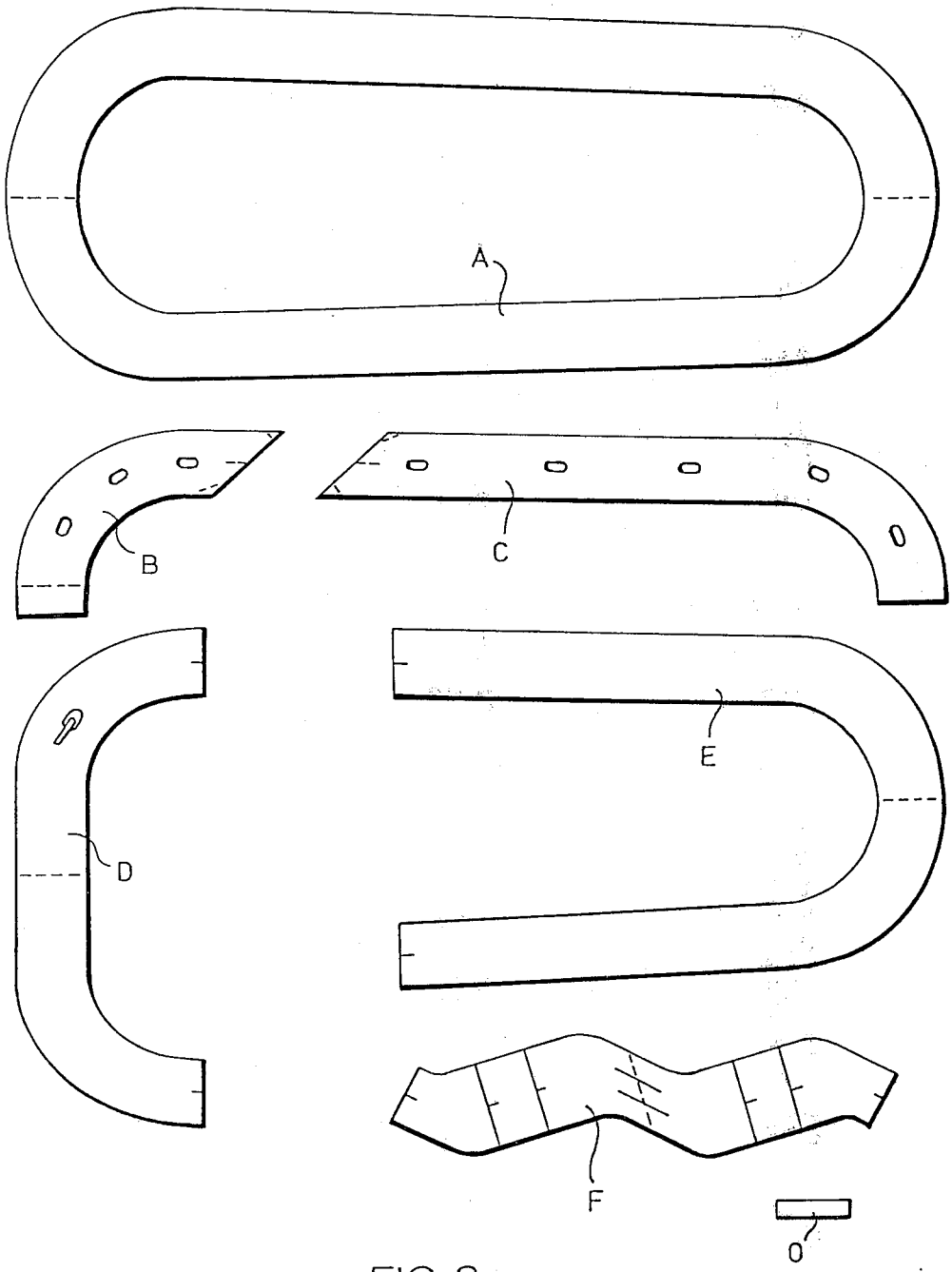
Figure 8B:
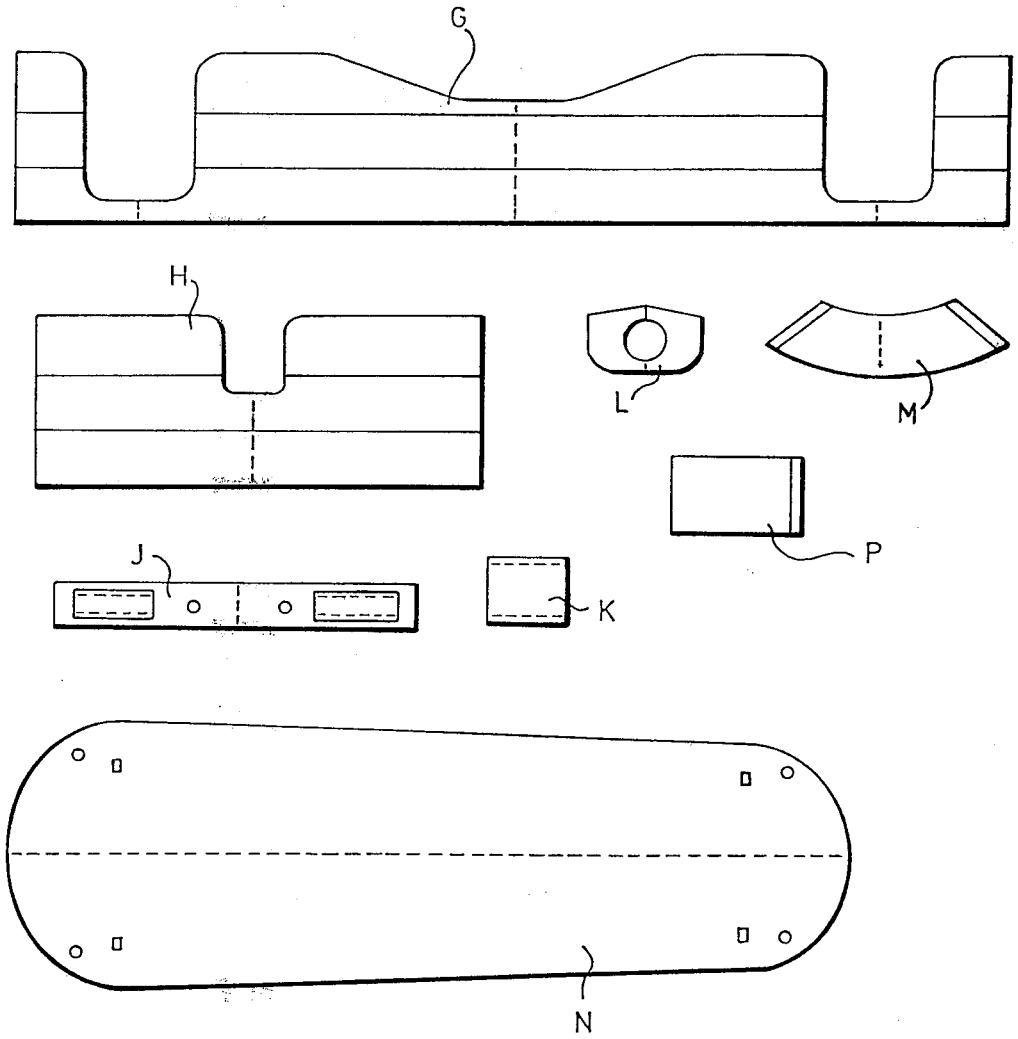

FIGS. 8*a* and 8*b* are patterns showing component pieces of the mattress of FIG. 2.

Figure 1:
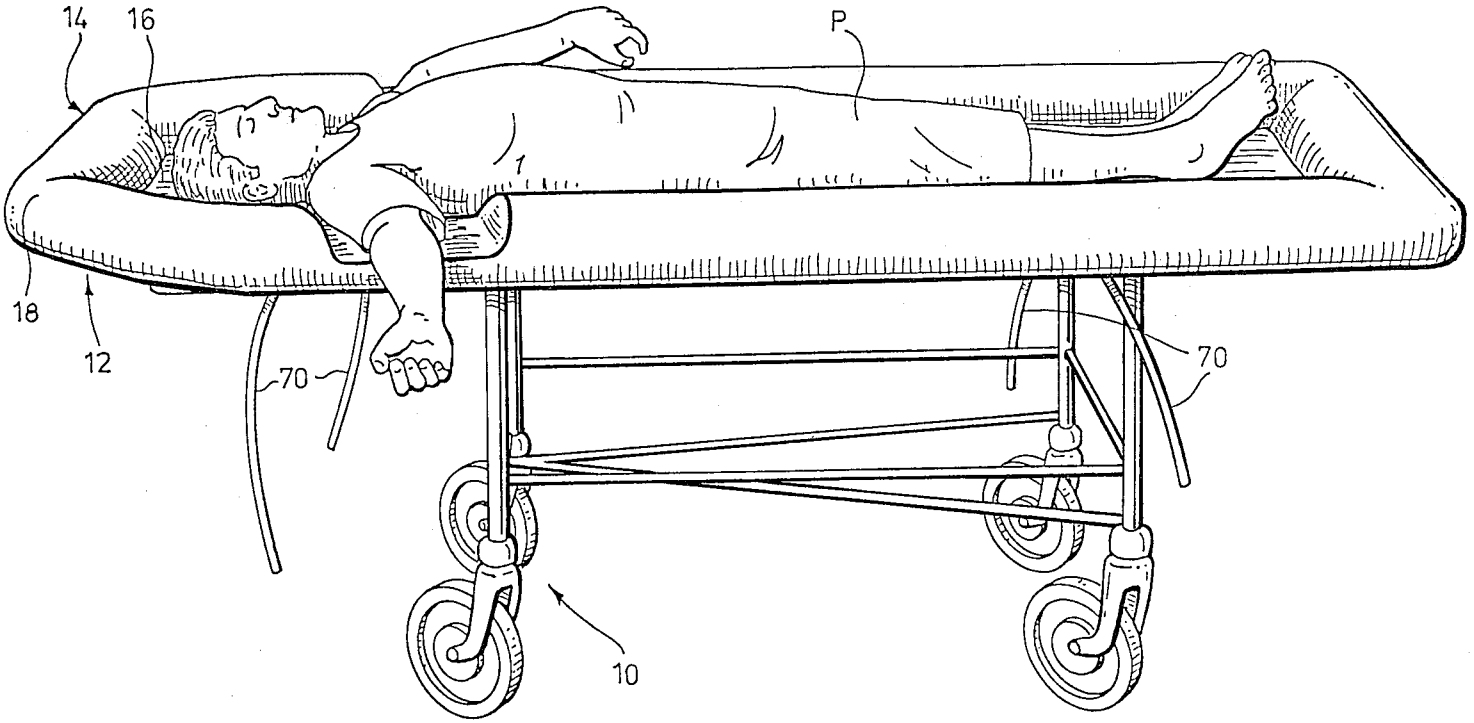
FIG. 1 is a general view of a patient lying on an operating table with a mattress in the stored position.

Referring now to FIG. 1, an operating table 10 includes a generally horizontal surface 12 to support a patient P at a convenient height. Interposed between the patient P and the surface 12 is a mattress generally designated 14 which includes a base 16 and a peripheral inflatable wall 18. The mattress 14 is secured to the table 12 by straps (not shown) attached to the base 16.

As shown in FIG. 1, the wall 18 is in a deflated condition to provide unrestricted access to the patient "P" but may be inflated to the position shown in FIG. 2 by release of compressed gas stored in pressurised containers 20. The containers 20 are secured by pouches 22 to the wall 18 and are conveniently standard 0.5 lb $CO_2$ cylinders. The containers 20 are located on opposite sides of the centre line of the mattress and permit inflation of the mattress with minimal disturbance to the patient. The inflation proceeds in opposite directions from the cylinders and the use of two cylinders provides adequate gas flow for rapid and orderly inflation.

The wall 18 is formed from inner and outer side wall members 24, 26 respectively which are interconnected by upper and lower wall members 28, 30 respectively. The lower wall member 30 may in fact be an extension of the base 16 to avoid an additional joint in the structure. Intermediate webs 32 interconnect the side wall members 28, 30 to prevent ballooning of the wall 18 in an inflated condition and have a number of holes 33 to permit flow of gas within the wall 18.

The wall members 24–30 and base 16 are manufactured from polyurethane coated six ounce plain weave nylon and the seams between the wall members sealed by a RF sealing machine. The wall members therefore provide a gas tight hollow wall structure so that admission of air into the interior of the wall 18 will inflate the wall to the upstanding condition shown in FIG. 2.

The wall 18 is provided with a pair of arm recesses 34 to permit the patient's arm to extend across the wall 18 when the wall in inflated. Each recess 34 is defined by a pair of opposed end walls 36 attached to the upper wall member 30, the inner and outer wall members 24, 26 and upper and lower intermediate webs 32. A closure member 38 extends between the lowermost edges of the end walls 36 and is attached to the edges of the lower wall member 30. The closure member 38 is also attached to the lower wall member 30 intermediate its edges so that a number of passages 40 are defined to permit communication of gas from one side of the recess to the other.

Sealing is provided around the patient's arms by flap means which comprise a cuff 44 and a flap 46. The cuff 44 is attached by welding to the inner side walls 24 adjacent the base 16 and has a pair of releasable fasteners 47 to secure the cuff 44 snugly around the patient's arm.

The flap 46 is attached to the inner side wall 24 at one side of the recess 34 and is provided with releasable fasteners 48 on its opposite edge to cooperate with fasteners 50 provided on the opposite side of the recess 34. The lower edge of the flap 46 overlies the upper edge of the cuff 44 so that an effective seal is provided to inhibit egress of water.

A head recess 52 is provided in the wall 18 between the arm recesses 34 to permit access to the patient's head and accomodate life support systems. The head recess 52 is defined by a pair of end panels 56 which are interconnected by an intermediate panel 58. The panel 58 is located approximately midway between the upper and lower wall members 28, 30.

Inlet valves 60 are provided in the outer wall member 26 on opposite sides of the recess 52. The valves 60 are adapted to connect with the outlet of the cylinders 20 and are attached to the wall member 26 by a suitable adhesive such as Bostik 1125A (Bostik is a registered Trade Mark). The cylinders 20 are controlled by pins 62 which are interconnected by a wire 64 to enable both pins to be removed together.

A manual inflation valve 66 is provided in the upper wall 28 adjacent the head recess to facilitate inflation should the cylinders 20 fail to inflate adequately the wall 18.

To provide drainage for melted ice, four drain ports 68 are provided in diametrically opposed locations. Each port 68 includes a drain pipe 70 secured to a nozzle 72 which is attached to the base 16 and provides an aperture 74 in the base 16. A filter 76 formed from a length of tube with perforated walls is inserted into the aperture 74 to be secured snugly to the nozzle 72. The filter 76 ensures that the aperture 74 is not blocked by a single ice cube. The lower end of the drain pipes 70 may be placed in suitable pails to collect water that flows through the pipes 70.

In use, the mattress 14 is placed in the deflated condition on the table 12 and secured by straps (not shown). The patient P is positioned with his head adjacent the head recess 54 and with his arms extending across the wall 18 in the area of the side recesses 34. The surgeon and anethetist may then operate upon the patient without encumberance from the mattress. Upon detection of malignant hyperthermia, the anethetist inflates the wall 18 by pulling the wire 64 to remove pins 62 and release the contents of the cylinders 20. The pressurised gas flows through the inlet valve 60 between the wall members 24–30. The holes 33 in the partitions 32 and passageways 40 permit uniform distribution of the gas throughout the wall 18 so that it rises in a controlled manner. The arm recesses 34 and head recess 52 permits inflation of the wall 18 without disturbing the patient or the life support systems attached to him. After inflation of the wall 18, the cuffs 44 are secured around the patients arms and the flap 46 fastened across the upper portion of the recess 34. Ice is then packed around the patient whilst the surgeon continues to operate so that the patient may be brought back to consciousness. Any ice that melts is removed from the mattress by the drain ports 68 so that the possibility of water leaking on to the floor is reduced.

The inflation operation occurs in a very short time with a minimum of supervision and disturbance to the patient. This permits the anethetist and surgeon to continue with essential work and enables the support staff to perform their normal duties. The area around the operating table does not become cluttered with additional equipment so that the operation may proceed in an orderly manner.

Whilst the mattress 14 may be constructed in a number of different ways, FIGS. 8*a* and 8*b* show a pattern suitable for obtaining the components required to construct the mattress shown in the preferred embodiment.

The lower wall member 30 is cut from a single piece of material A and placed with the coated side uppermost. The base 16 is cut from a piece N to overlap the inner edge of piece A. Four pieces B are used to provide the partitions 32 in the head end of the wall 18 with two of the pieces B being joined to define a U to form the lowermost partition which extends between the recesses 34. The remaining pieces B are shortened, as shown by dotted lines, to provide the upper partitions 32 which extend from each arm recess 34 to the head recess 52.

The partitions in the foot end of the mattress 14 are formed from four pieces C which are joined in pairs to provide two U shaped partitions which extend around the foot of the mattress between the arm recess 34. Because the recesses 34 are angled with respect to the wall 18, the edges of the pieces B and C intersect at an acute angle of 45°. These extremities are cut off ¾ of an inch from each end to provide less bulk during assembly. The holes 33 are cut into the pieces B & C before they are joined together.

The upper wall member 28 is formed from two pieces D, E and the manual inflation valve 66 glued to the piece D in an appropriate location. The distance between the ends of the piece D is greater than that of piece E to provide the extra material to form the side panels 56 and intermediate panels 58 of head recess 52.

The opposed end walls 36 and closure member 38 are provided by a generally zig zag piece F. The zig zag ensures that the opposed side walls 36 lie generally parallel to one another and at the desired angle to the wall 18 when the mattress is assembled. The inner and outer wall members 24, 26 are each formed by two pieces G. H. The piece G extends around the foot end of the mattress and includes the discontinuities for the arm recesses. The piece G for the inner wall 24 is cut shorter than the piece G for the outer wall 26 to accomodate the thickness of the inflated wall. Similarly the piece H extends around the head end of the mattress 14 and has a cut out for the head recess 52.

The area of the outer wall member H which supports the cylinder 20 is reinforced by a patch J having two holes to accomodate the inlet valves 60. The pouches 22 are formed on the patch J by rectangular pieces K.

The cuffs 44 are formed from two pieces L, M which are joined together to form a flanged funnel shape. The piece L is slit to coincide with the edges of the piece M to provide opening of the cuff 44. The piece P provides the flap 46.

Reinforcing patches may be provided around the apertures for the drain pipes 68 and inflation valves 66 and 60 although these are not shown for clarity of description. Similarly suitable straps may be cut to provide the securing straps 15 although these are not shown.

Assembly of the mattress commences by joining two pieces C together at the foot end with a ¼ inch seam. The joined pieces are then attached to each of the pieces G at the bottom partition line starting at the centre line of G and working each way toward the arm recess 34. This is conveniently done with the RU sealing machine described above by folding the periphery of C to provide a seam lining on the surface of the piece G.

The above procedure is then repeated with the remaining two pieces C at the top partition line. The seams joining the pieces C and G are orientated so that the bottom seam is to the bottom and the top seam is to the top.

The piece E is then sealed to the inside and outside wall members 24, 26 (pieces G) starting at the foot end and working toward the arm recess 34. The last two inches of the piece E is not sealed to permit subsequent assembly of the mattress. The lower wall member 30 (piece A) is similarly attached to within 3 inches of the recess 34 with a ¼ inch overlap being provided by piece G forming the inside wall 24 to enable the floor N to be attached later.

Two rib pieces O are attached to the piece F to provide the passages 40 between the closure member 38 and the lower wall member 30. These rib pieces O are then attached to the lower wall member 30 (piece A) and the arm recesses sealed by joining the edge of piece F to the piece G. This proceeds from the centre line of the piece F toward the upper wall member 28 (piece E). As the partitions (pieces C) are reached, they are sealed to piece G and to piece F. The last half inch is left for a seam and the piece E is then sealed to pieces G and finally to piece F.

The head end is assembled in a similar manner with the full size pieces B being joined together and then attached to the inner and outer side wall members 24, 26 provided by pieces H. The last two inches of P are left unsealed for subsequent assembly.

The shortened pieces B are then attached to the pieces H starting at the head recess and working toward the edge of H up to the last 2".

The piece D is then installed starting at the centre line of the head recess and working around the recess and toward the edge of piece H. The partitions B are sealed to the piece D as the sealing continues and the last 2 inches are left free. The inlet valves 60 and the patch J is then installed leaving sufficient time for the adhesive to set. The head end is now ready for assembly to the foot end.

The inside wall member 24 is first secured to the lower wall member 30 (piece H to piece A) starting at the centre line and working toward the arm recess 34. A ¼ inch overlap of piece G is provided for securing the base. The last 2 inches of piece H is left free. This is then repeated for the outer wall member 26 but without the overlap. Piece G is then sealed to piece H along a vertical line ensuring that the join corresponds to the dimensions of piece A. Piece A is not joined to pieces G & H at this time.

The partitions B are then sealed across the vertical seam to pieces G and H. The piece F is then sealed into the arm recess in piece G by working from the centre line of F toward the head end. The partitions B are sealed to the piece F as this proceeds. The last ½ inch of piece F is left for a seam and the sealing of piece D to pieces G and H completed. The upper edge of F is then sealed to the edge of piece D.

The rib pieces O are then secured to lower wall member (piece A) and the sealing of the lower wall member 30 to the inner and outer wall members 24, 26 completed (i.e. piece A is sealed to pieces G and H).

The cuffs 44 and flap 46 are then attached at appropriate locations in the recess and the base 16 (piece N) attached to the ¼ overlap left on piece G, working from the head end toward the foot.

The mattress may then be inflated to test for leaks and to ensure integrity of the assembly. In the embodiment shown, a tapered profile is provided for the side wall. This reduces the internal capacity of the wall 18 so that adequate inflation is available from two ½ lb $CO_2$ cylinders. Other configurations could be adopted if desired, with appropriate changes to the components.

It will be seen therefore that a mattress is provided which facilitates treatment of malignant hyperthermia without unduly disturbing the treatment of the patient and without unduly encumbering the operating area. The mattress is available for use at all times and requires a minimum of attention to put it into services. The use of two cylinders to inflate the mattress ensures rapid and uniform inflation with minimum disturbance to the patient and the single cavity defined by the wall members ensures an even distribution of the pressurised gas with a uniform pressure throughout the inflated mattress.

The embodiments of the invention in which an exclusive property or privilege is claimed are defined as follows:

1. A mattress adapted to overlie an operating table for use in the treatment of malignant hyperthermia, comprising a base having a peripheral edge, an inflatable wall extending around said peripheral edge and having an upper portion delimiting said wall and a lower portion operatively connected to said base, said wall including a pair of recesses positioned in opposed areas of said wall and extending from said upper portion toward said lower portion, to accommodate the arms of a patient lying on said mattress, flexible flap means extending across each of said recesses, and inflation means associated with said wall to inflate said wall from a generally deflated condition in which said upper edge lies adjacent said base to an inflated condition in which said wall is upstanding.

2. A mattress according to claim 1 wherein said wall includes a further recess located between said pair of recesses.

3. A mattress according to claim 1 including drain means in said base to permit drainage of fluid through said base.

4. A mattress for use in treatment of malignant hyperthermia comprising a base adapted to overlie an operating table, an inflatable wall extending around the periphery of said base, said wall comprising an inner wall member, an outer wall member spaced from said inner wall member, and upper and lower interconnecting wall members extending between said inner and outer wall members at spaced locations, said wall including a pair of opposed recesses extending from discontinuities in said upper wall member toward said lower wall member to accommodate the arms of a patient lying on said mattress, flexible flap means extending across each of said recesses and inflation means associated with said wall to permit inflation thereof whereby said wall may be inflated from a deflated condition to upstanding inflated condition.

5. A mattress according to claim 4 wherein said recesses are defined by a pair of spaced opposed end walls connected between said inner and outer walls and attached to upper wall member.

6. A mattress according to claim 5 wherein communication means are provided between said side walls to permit air to pass within said wall from one side of said recess to another.

7. A mattress according to claim 6 wherein said communication means includes a plurality of passages formed between said lower wall member and a closure member extending between said side walls.

8. A mattress according to claim 7 including a pair of inlets for pressurized gas for inflation of said wall, said inlets being arranged to provide rapid inflation of said wall in opposite directions around the periphery of said base.

9. A mattress according to claim 4 including partition members extending from said inner wall to said outer wall between said upper and lower wall members, said partition members having a plurality of apertures to permit air flow across said partition members within said wall.

10. A mattress according to claim 4 including a further recess located intermediate said pair of recesses.

11. A mattress according to claim 10 wherein said inflation means includes a pair of pressurised gas cylinders located on said wall on opposite sides of said further recess, said cylinders causing rapid inflation of said wall in opposite directions around said base.

12. A mattress according to claim 4 wherein said flap means includes an upper flap and a cuff located below said upper flap to seal around an arm passing through said recess.

13. A mattress according to claim 12 wherein said upper flap is attached to said inner wall at one side of said recess and securing means are provided on said inner wall on the opposite side of said recess to hold said upper flap across said recess.

14. A mattress according to claim 12 wherein said cuff is formed from a pair of cuff members extending from opposite sides of said recess.

15. A mattress for use in treatment of malignant hyperthermia comprising a generally rectangular base with a head edge, a bottom edge and a pair of side edges, an inflatable wall extending around said edges to encompass a patient lying on said base, said wall having a lower portion connected to said base and an upper portion delimiting said wall, a discontinuity in each portion of said wall connected to said side edges, each of said discontinuities extending downwardly from the upper portion to provide a pair of opposed recesses permitting an arm of said patient to extend through said wall, sealing means associated with each of said recesses to extend across said discontinuity and seal around said arm, and inflation means to inflate said wall.

16. A mattress according to claim 15 wherein drain means are provided in said base.

17. A mattress according to claim 15 wherein a further discontinuity is provided in said wall adjacent said head edge to permit access to the head of a patient lying on said base.

* * * * *